US009016333B2

(12) United States Patent
Shaffer

(10) Patent No.: US 9,016,333 B2
(45) Date of Patent: Apr. 28, 2015

(54) BOTTOM FILL KITCHEN SINK FEATURE

(71) Applicant: General Electric Company, Schenectady, NY (US)

(72) Inventor: Timothy Scott Shaffer, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 219 days.

(21) Appl. No.: 13/732,614

(22) Filed: Jan. 2, 2013

(65) Prior Publication Data

US 2014/0182744 A1 Jul. 3, 2014

(51) Int. Cl.

| | |
|---|---|
| ***B67D 1/06*** | (2006.01) |
| ***B67D 7/84*** | (2010.01) |
| ***B65D 1/04*** | (2006.01) |
| ***E03B 9/20*** | (2006.01) |
| ***B65D 1/06*** | (2006.01) |
| ***B65D 47/24*** | (2006.01) |
| *A47G 19/22* | (2006.01) |

(52) U.S. Cl.

CPC .. *B67D 7/84* (2013.01); *B65D 1/04* (2013.01); *E03B 9/20* (2013.01); *A47G 19/2205* (2013.01); *B65D 1/06* (2013.01); *B65D 47/248* (2013.01)

(58) Field of Classification Search

USPC ..... 141/113, 348–349, 351–356, 383

See application file for complete search history.

(56) References Cited

U.S. PATENT DOCUMENTS

| | | | | |
|---|---|---|---|---|
| 4,877,065 | A * | 10/1989 | Lamboy et al. | 141/18 |
| 7,708,035 | B2 * | 5/2010 | Windmiller | 141/113 |
| 7,766,057 | B2 * | 8/2010 | Windmiller | 141/113 |
| 7,824,545 | B2 * | 11/2010 | Windmiller | 210/110 |
| 8,082,956 | B2 * | 12/2011 | Windmiller | 141/113 |
| 8,113,247 | B2 * | 2/2012 | Windmiller | 141/113 |
| 8,151,838 | B2 * | 4/2012 | Seaborne et al. | 141/350 |
| 8,215,344 | B2 * | 7/2012 | Windmiller | 141/113 |
| 8,827,106 | B2 * | 9/2014 | Windmiller | 220/709 |
| 2008/0142421 | A1 * | 6/2008 | Windmiller | 210/137 |
| 2008/0169048 | A1 * | 7/2008 | Windmiller | 141/113 |
| 2008/0185071 | A1 * | 8/2008 | Windmiller | 141/113 |
| 2008/0223478 | A1 | 9/2008 | Hantsoo et al. | |
| 2008/0277020 | A1 * | 11/2008 | Windmiller | 141/113 |
| 2010/0043911 | A1 | 2/2010 | Russell | |

* cited by examiner

*Primary Examiner* — Nicolas A Arnett

(74) *Attorney, Agent, or Firm* — Dority & Manning, P.A.

(57) ABSTRACT

A bottom fill, fluid dispensing system is provided having a dispenser capable of being mounted to a countertop and a container. The container may be placed onto the dispenser and the dispenser may be moved to a first position, to allow the dispenser to fill the container with a fluid. The container may be filled through a one way valve in the container wall. Once the container is filled to a desired level, the dispenser may be moved to a second position and the container may be removed from the dispenser without the fluid leaking from the one way valve in the container wall.

20 Claims, 5 Drawing Sheets

BOTTOM FILL KITCHEN SINK FEATURE

FIELD OF THE INVENTION

The subject matter of the present disclosure relates generally to a fluid dispensing system that fills a container from the bottom and may be mounted to a countertop.

BACKGROUND OF THE INVENTION

Fluid dispensers, such as beverage dispensers, traditionally fill containers through a main opening in the container. This may be accomplished by simply pouring a fluid into the container or by positioning the container under a faucet with a sufficient vertical profile to accommodate the height of the container. For instance, in the context of a kitchen, a container may be filled with tap water by positioning the container in a sink underneath a tap water faucet.

In addition to a tap water faucet over a sink, some households may also include a separate, auxiliary faucet in fluid connection with a water filter, or more particularly, with a point of use water filter. Such a water filter may be installed, e.g., under a kitchen countertop or in a refrigerator. An auxiliary faucet such as this may be used to provide filtered water for direct consumption.

Certain challenges exist with this construction, however. Such construction, for example, may take up additional counter space as the auxiliary faucet must have a sufficient vertical profile to accommodate the height of a container. Additionally, an auxiliary faucet may be aesthetically unacceptable in certain situations. Accordingly, a fluid dispensing system capable of filling a container while having one or more features that facilitate a lower profile or that allows the system to take up less space on a countertop would be beneficial.

BRIEF DESCRIPTION OF THE INVENTION

The present disclosure provides a bottom fill, fluid dispensing system having a dispenser capable of being mounted to a countertop. Further, a container may be placed onto the dispenser to allow the dispenser to fill the container with a fluid. The container may be filled through a one way valve in the container wall. Once the container is filled to a desired level the container may be removed from the dispenser without the fluid leaking from the one way valve in the container wall. Aspects and advantages of the invention will be set forth in part in the following description, or may be apparent from the description, or may be learned through practice of the invention.

In one exemplary embodiment, the present disclosure provides a bottom fill, fluid dispensing system, including a valve housing mountable to a countertop, the valve housing including a fluid inlet and a chamber that defines an axial direction. The bottom fill, fluid dispensing system may also include a valve body received within the chamber and slidable along the axial direction of the valve housing. The valve body may define a channel for the flow of fluid, the channel extending between an inlet port and an outlet port of the valve body. The valve body may be slidable between a first position and a second position. In the first position the inlet port of the channel may be aligned with the fluid inlet of said valve housing so that fluid may flow from the fluid inlet, through the inlet port, and into the channel. In the second position fluid may be blocked from flowing from the fluid inlet through the inlet port of said valve body. The bottom fill, fluid dispensing system may also include a biasing member configured so as to urge the valve body towards the second position, and a container removably positioned onto the valve body. The container may have a container wall in contact with the valve body when the container is positioned onto the valve body. Additionally, the bottom fill, fluid dispensing system may include a one-way valve received onto the container wall. The one-way valve may be positioned at the container wall so as to be able to receive fluid from the outlet port of the valve body when the container is positioned onto the valve body.

In another exemplary embodiment, the present disclosure provides a bottom fill, fluid dispensing system, including a valve housing mountable to a countertop, the valve housing including a fluid inlet and a chamber that defines an axial direction. The bottom fill, fluid dispensing system may also include a valve body including a first end and a second end, and a channel for the flow of fluid extending between an inlet port and an outlet port. The inlet port may be positioned at the first end of the valve body, and the second end of the valve body may be received within the chamber of the valve housing such that the valve body may slide in the axial direction between a first position and a second position. In the first position, the inlet port of the valve body may be aligned with the fluid inlet of the valve housing so that fluid may flow from the fluid inlet, through the inlet port, through the channel, and through the outlet port. In the second position, fluid may be blocked from flowing from the fluid inlet of the valve housing to the inlet port of the valve body. The bottom fill, fluid dispensing system may also include a biasing member positioned at the second end of the valve body configured for urging the valve body towards the second position, and a container removably positioned onto the valve body. The container may have a container wall in contact with the first end of the valve body when the container is positioned onto the valve body. Additionally, the bottom fill, fluid dispensing system may include a one-way valve received into an aperture in the container wall. The one-way valve may be positioned in the aperture in the container wall so as to be able to receive fluid from the outlet port of the valve body when the container is positioned onto the valve body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
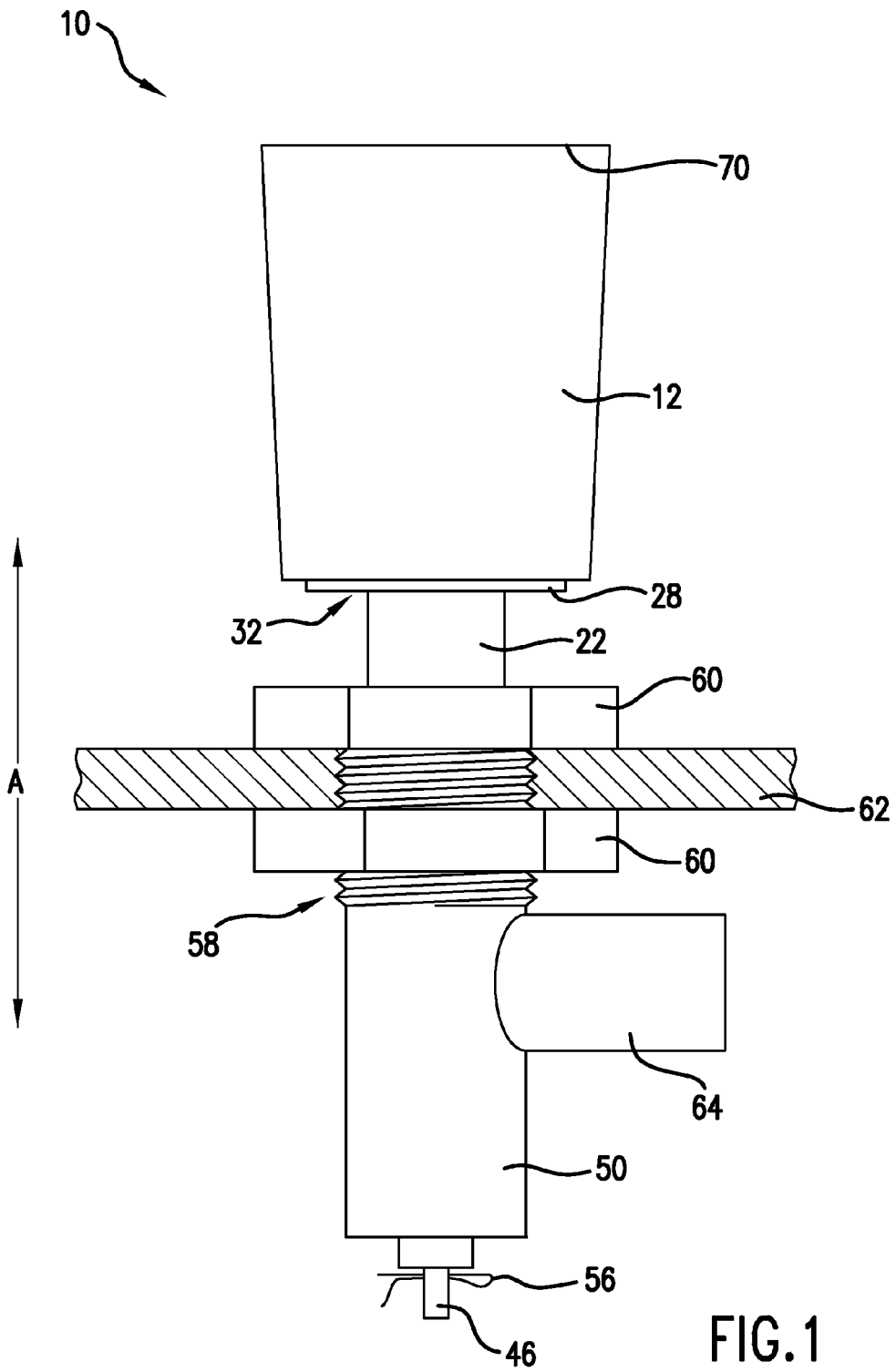
FIG. 1 provides a side view of an exemplary embodiment of a bottom fill, fluid dispensing system of the present disclosure.

Reference now will be made in detail to embodiments of the present disclosure, one or more examples of which are illustrated in the drawings. Each example is provided by way of explanation of the present disclosure, not limitation of the present disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present invention covers such modifications and variations as come within the scope of the appended claims and their equivalents.

Figure 2:
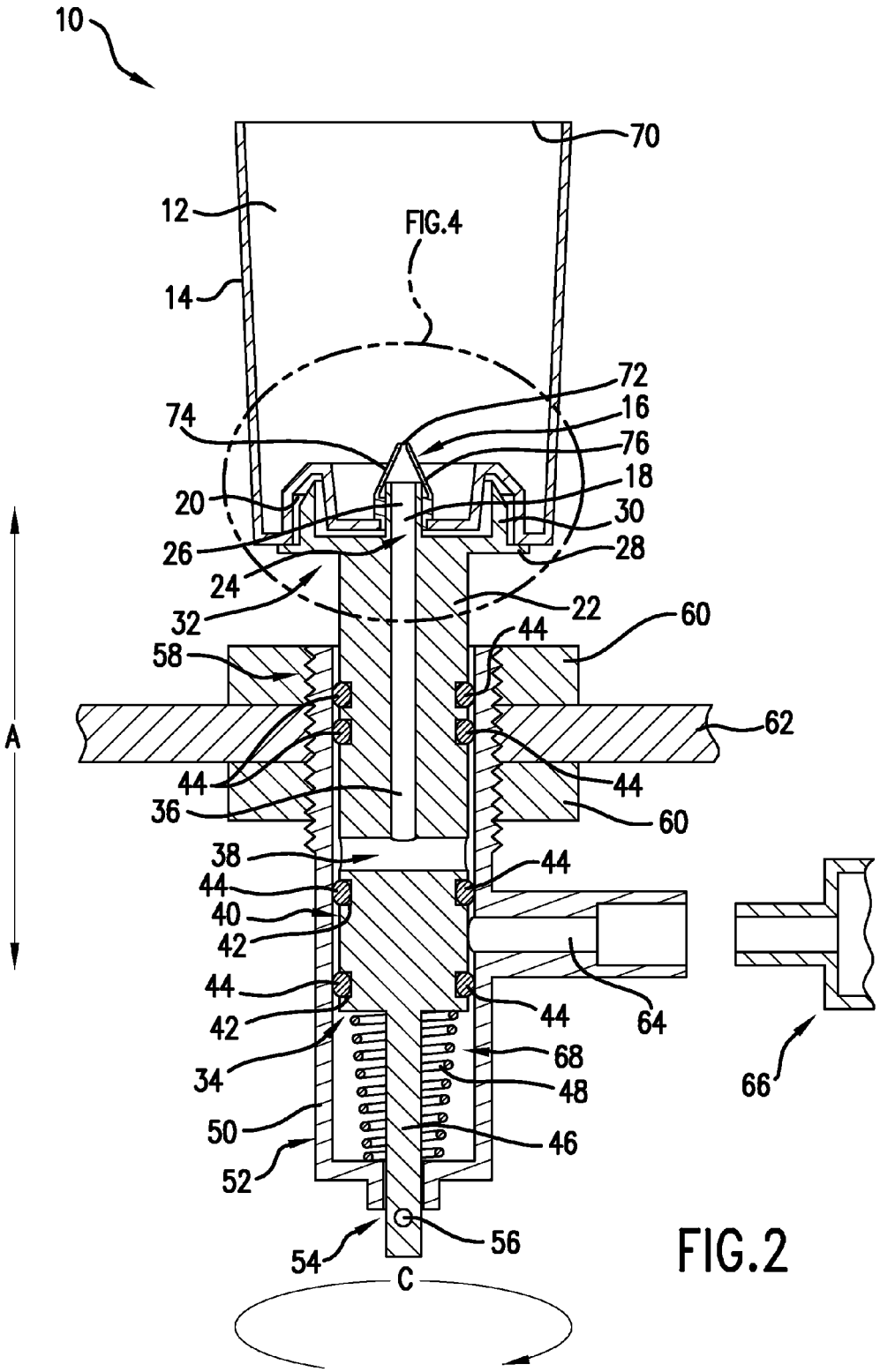
FIG. 2 provides a cross-sectional side view of an exemplary embodiment of a bottom fill, fluid dispensing system of the present disclosure in a position where fluid does not flow into the container.

FIGS. 1 and 2 provide a side view and a side cross-sectional view of an exemplary embodiment of a bottom fill, fluid dispensing system 10 of the present disclosure. In this embodiment, bottom fill, fluid dispensing system 10 includes a container 12, a valve body 22, and a valve housing 50, wherein valve housing 50 may be mounted to a countertop 62. Countertop 62, as used herein, refers to any fixed surface and is not limited to, e.g., a kitchen or bathroom countertop. For instance, the present disclosure contemplates exemplary embodiments wherein valve housing 50 may be mounted to tabletops, bar tops, a sink, a fixed surface, and other embodiments as well.

Valve housing 50 includes a fluid inlet 64 and a chamber 68, wherein chamber 68 defines an axial direction A. In one exemplary embodiment, valve housing 50 may have an exterior surface 52 that includes a threaded portion 58 allowing it to be mounted to countertop 62 using two retaining nuts 60. Retaining nuts 60 may be positioned on opposing sides of countertop 62 and may be in engagement with threaded portion 58 of valve housing 50, allowing valve housing 50 to remain in a fixed position relative to countertop 62. By mounting valve housing 50 as shown in FIGS. 1 and 2, bottom fill, fluid dispensing system 10 may achieve a low profile and consume little space on countertop 62.

Figure 3:
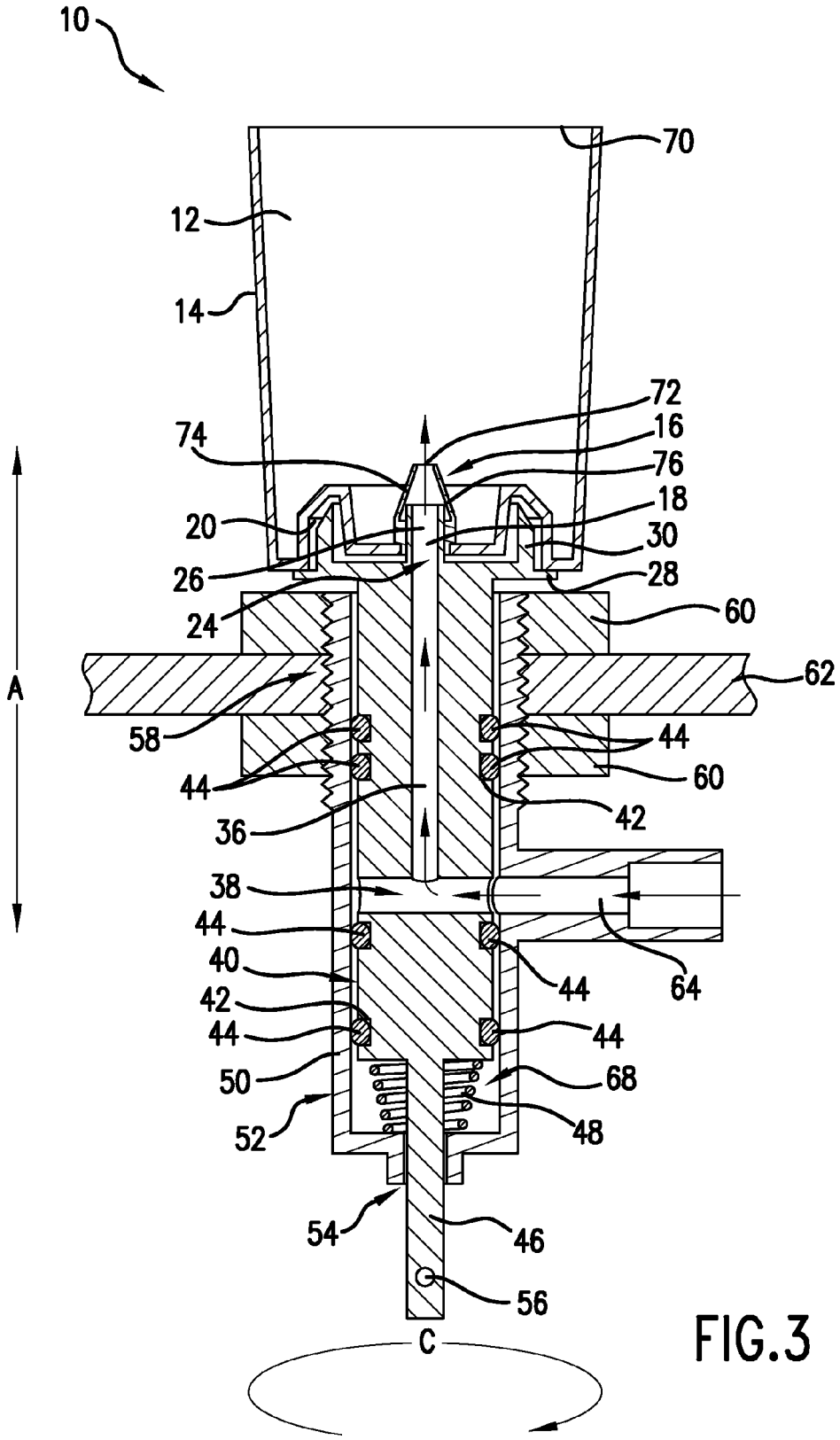
FIG. 3 provides a cross-sectional front view of the flow of a fluid through an exemplary embodiment of a bottom fill, fluid dispensing system of the present disclosure in a position where fluid can flow into the container.

Valve body 22 may include a first end 32 and a distal end, or a second end 34, as well as a channel 36 for the flow of fluid that extends between an inlet port 38 and an outlet port 24. Valve body 22 may also define a circumferential direction, C. Outlet port 24 is positioned at first end 32 of valve body 22. Second end 34 of valve body 22 is received within chamber 68 of valve housing 50 such that valve body 22 may slide along axial direction A. Valve body 22 is slidable between a first position shown in FIG. 3 and a second position shown in FIG. 2. In the first position, as shown in FIG. 3, valve body 22 is positioned within valve housing 50 such that fluid inlet 64 of valve housing 50 aligns with inlet port 38 of valve body 22. This position allows fluid to flow from fluid inlet 64, through inlet port 38, into and through channel 36, and through outlet port 24, as is indicated by the arrows in FIG. 3. In the second position, as shown in FIG. 2, valve body 22 is positioned within valve housing 50 such that fluid is blocked from flowing from the inlet 64 of valve housing 50 through inlet port 38 of valve body 22.

Referring to FIG. 2, fluid inlet 64 of valve housing 50 may be in fluid connection with any pressurized fluid source. In this exemplary embodiment, fluid inlet 64 is in fluid connection with a water filtering system 66, including a filter for removing particles from the water. Water filtering system 66 may be a point of use water filter installed beneath countertop 62, and it may be in fluid communication with, e.g., a commercial or residential water supply. This would enable bottom fill, fluid dispensing system 10 to deliver filtered water to the user for, e.g., direct consumption. Other configurations may be used as well.

For the exemplary embodiment shown, valve body 22 includes an exterior surface 40 defining a plurality of grooves 42, spaced apart along axial direction A and extending in a circumferential direction C around valve body 22. Additionally, bottom fill, fluid dispensing system 10 includes a plurality of seals, such as O-rings 44, positioned in plurality of grooves 42 and configured for providing a fluid seal between valve body 22 and valve housing 50. In this exemplary embodiment, O-rings 44 are positioned along valve body 22 such that when valve body 22 is in the first position, as shown in FIG. 3, or in the second position, as shown in FIG. 2, a pair of O-rings 44 are positioned on opposing sides in axial direction A of where fluid inlet 64 meets chamber 68.

Bottom fill, fluid dispensing system 10 includes a biasing member, such as a spring 48, configured so as to urge valve body 22 towards the second position, as is shown in FIG. 2. Spring 48 is positioned in chamber 68 and is in contact with second end 34 of valve body 22. In this exemplary embodiment, valve body 22 further includes a stem 46 extending from second end 34 of valve body 22 along axial direction A, while other embodiments may not. Stem 46 is slidably received through an opening 54 in valve housing 50. Stem 46 may have a non-circular cross-sectional geometry, such as a square. This may prevent valve body 22 from rotating in circumferential direction C, and thus help keep fluid inlet 64 of valve housing 50 in alignment with inlet port 38 of valve body 22 when valve body 22 is in the first position, as in FIG. 3. Additionally, a pin 56 may be positioned at the end of stem 46. Pin 56 may function to ensure valve body 22 is in a proper axial position when in the second position, as in FIG. 2.

In this exemplary embodiment, container 12 includes a container wall 14 and a main opening 70. Container 12 is removably positioned onto the first end 32 of valve body 22, such that container wall 14 is in contact with valve body 22 when positioned onto valve body 22. Additionally, as shown in FIG. 2 and in the close-up view of FIG. 4, container 12 includes a one-way valve received within container wall 14, or more particularly, received within an aperture 18 in container wall 14. The one-way valve may be a flexible member made from any suitable material, such as silicone, and configured for opening to allow fluid to flow from outlet port 24 of valve body 22 through aperture 18 of container 12 when container 12 is positioned on valve body 22. When fluid is not flowing through one-way valve into container 12, the one-way valve is configured for closing to block a flow of fluid from container 12 and out of aperture 18 in container wall 14 into, e.g., outlet port 24 or otherwise. In one exemplary embodiment, the one-way valve may be a duckbill valve 16 as shown that defines a slot 72 created by the edges 74 of a flexible member 76. A flow of fluid through outlet port 24 opens flexible member 76 and slot 72 to allow a flow of fluid into container 12. When fluid is not exiting outlet port 24, slot 72 closes as the edges 74 of flexible member 76 collapse onto each other to form a seal. Other flexible members for providing one-way flow may be used as well.

Figure 4:
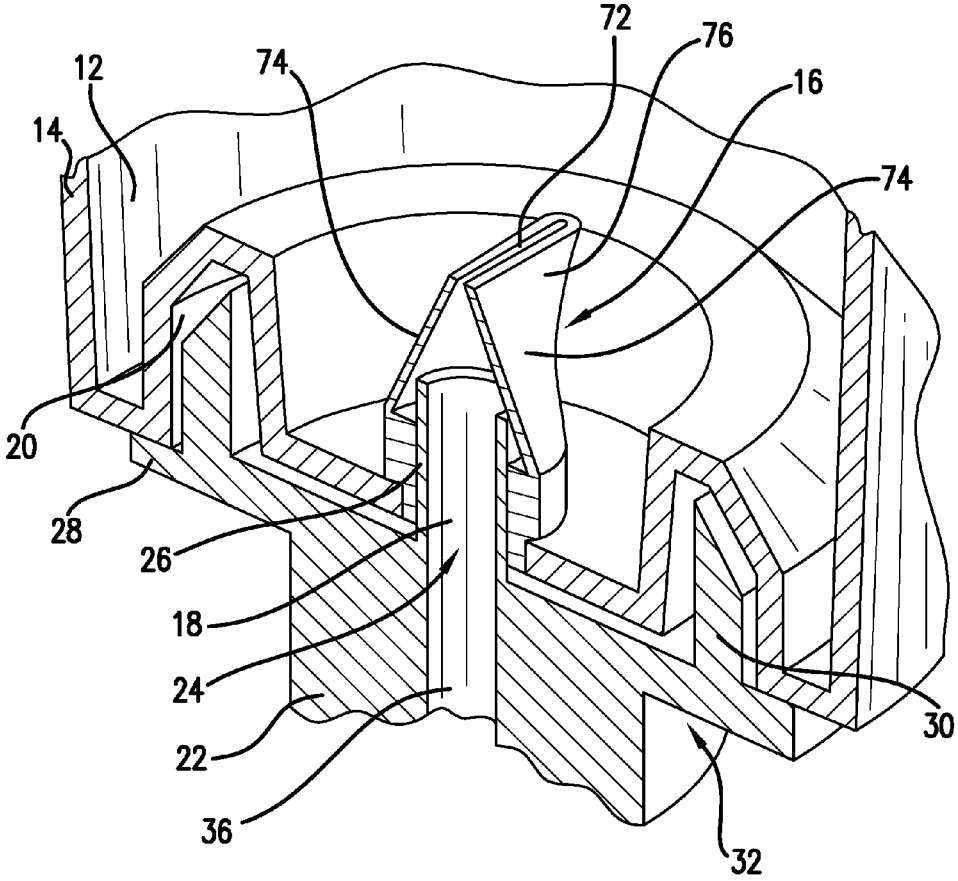
FIG. 4 provides a close-up, cross-sectional and perspective view of a portion of an exemplary embodiment of a bottom fill, fluid dispensing system of the present disclosure.

As shown more clearly in FIG. 4, in one exemplary embodiment of the present disclosure, valve body 22 includes a boss 30 extending along axial direction A. In complementary fashion, container 12 defines a recess 20 into which boss 30 is received when container 12 is positioned onto valve body 22. Boss 30 and recess 20 are configured to align outlet port 24 of valve body 22 with the one-way valve in aperture 18 in wall 14 of container 12. Other embodiments of the present disclosure, however, are contemplated without boss 30 and recess 20. In another exemplary embodiment, outlet port 24 further includes a conduit 26 extending along axial direction A and out of first end 32 of valve body 22. Conduit 26 is positioned for mating alignment with the one-way valve in aperture 18 of container 12, when container 12 is positioned onto valve body 22. In still another exemplary embodiment, first end 32 of valve body 22 further includes a top plate 28 positioned so as to make contact with and support container 12 when container 12 is positioned onto valve body 22. In yet another exemplary embodiment, outlet port 24 extends through top plate 28, and boss 30 extends along axial direction A from top plate 28. For this exemplary embodiment, boss 30 also encircles valve 16 along the circumferential direction. Other configurations may be used.

Figure 5:
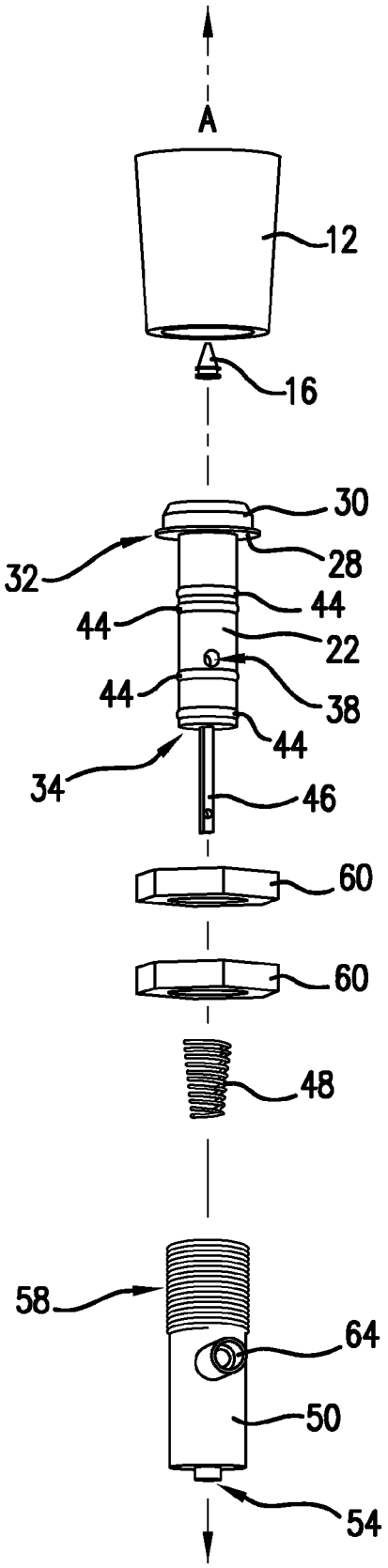
FIG. 5 provides an exploded view of an exemplary embodiment of a bottom fill, fluid dispensing system of the present disclosure.

FIG. 5 shows an exploded view of bottom fill, fluid dispensing system 10, illustrating how the various parts are disposed along axial direction A of chamber 68 of valve housing 50. For this exemplary embodiment, spring 48 is received into valve housing 50, followed by retaining nuts 60, each engaged, one after the other, around threaded portion 58 of valve housing 50. Valve body 22 is also received within valve housing 50, such that stem 46 is slidably received through opening 54 in valve housing 50. Additionally, duckbill valve 16 is received into container 12, and container 12 may be removably mounted to first end 32 of valve body 22. While duckbill valve 16 may be a component added to container 12, it should be understood that valve 16 could also be insert molded with container 12 as an integrated feature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bottom fill, fluid dispensing system, comprising:

a valve housing mountable to a countertop, said valve housing comprising a fluid inlet and a chamber that defines an axial direction;

a valve body received within the chamber and slidable along the axial direction of said valve housing, said valve body defining a channel for the flow of fluid, the channel extending between an inlet port and an outlet port of said valve body, wherein said valve body is slidable between:

a first position where the inlet port of the channel is aligned with the fluid inlet of said valve housing so that fluid may flow from the fluid inlet, through the inlet port, and into the channel, and a second position where the inlet port of the channel is not aligned with the fluid inlet of said valve housing such that fluid is blocked from flowing from the fluid inlet through the inlet port of said valve body;

a biasing member configured so as to urge said valve body towards said second position;

a container removably positioned onto said valve body, said container having a container wall in contact with said valve body when the container is positioned onto said valve body; and a one-way valve received onto the container wall, said one-way valve positioned at the container wall so as to be able to receive fluid from the outlet port of said valve body when the container is positioned onto said valve body.

2. A bottom fill, fluid dispensing system as in claim 1, wherein said biasing member is a spring.

3. A bottom fill, fluid dispensing system as in claim 1, wherein said valve body comprises a stem extending from a distal end of said valve body and along the axial direction of the chamber of said valve housing, the stem being slidably received through an opening defined by said valve housing.

4. A bottom fill, fluid dispensing system as in claim 3, wherein said biasing member comprises a spring positioned in the chamber of said valve housing in contact with the distal end of said valve body.

5. A bottom fill, fluid dispensing system as in claim 1, wherein said valve body defines an exterior surface comprising a plurality of grooves spaced apart along the axial direction, and wherein the dispensing system further comprises a plurality of seals received into said plurality of grooves and configured for providing a fluid seal between said valve body and said valve housing.

6. A bottom fill, fluid dispensing system as in claim 1, wherein said one-way valve comprises a duckbill valve.

7. A bottom fill, fluid dispensing system as in claim 1, wherein said one-way valve comprises flexible member configured for opening to allow fluid to flow from the outlet port of said valve body into said container and for blocking a flow of fluid from said container into the outlet port.

8. A bottom fill, fluid dispensing system as in claim 1, wherein the outlet port of said valve body comprises a conduit extending along the axial direction of the chamber of said valve housing and out of said valve body, said conduit positioned for mating alignment with said one-way valve when said container is positioned onto said valve body.

9. A bottom fill, fluid dispensing system as in claim 8, wherein said valve body defines a boss extending along the axial direction, and wherein the container wall of said container defines a recess into which said boss is received when said container is positioned onto said valve body, said boss and said recess configured to align the conduit of the outlet port with said one-way valve when said container is positioned onto said valve body.

10. A bottom fill, fluid dispensing system as in claim 1, further comprising a water filtering system including a filter for removing particles from the water, said water filtering system in fluid communication with the fluid inlet of said valve housing.

11. A bottom fill, fluid dispensing system, comprising:

a valve housing mountable to a countertop, said valve housing comprising a fluid inlet and a chamber that defines an axial direction;

a valve body comprising a first end and a second end and a channel for the flow of fluid extending between an inlet port and an outlet port, wherein the outlet port is positioned at the first end of said valve body, and wherein the second end of said valve body is received within the chamber of said valve housing such that said valve body may slide in the axial direction between:

a first position, wherein the inlet port of said valve body is aligned with the fluid inlet of said valve housing so that fluid may flow from the fluid inlet, through the inlet port, through the channel, and through the outlet port; and a second position, wherein the inlet port of the valve body is not aligned with the fluid inlet of said valve housing such that fluid is blocked from flowing from the fluid inlet of said valve housing to the inlet port of said valve body;

a biasing member positioned at the second end of said valve body configured for urging said valve body towards the second position;

a container removably positioned onto said valve body, said container having a container wall in contact with the first end of said valve body when the container is positioned onto said valve body; and a one-way valve received into an aperture in the container wall, said one-way valve positioned in the aperture in the container wall so as to be able to receive fluid from the outlet port of said valve body when the container is positioned onto said valve body.

12. A bottom fill, fluid dispensing system as in claim 11, wherein the first end of said valve body defines a boss extending along the axial direction, and wherein the wall of said container defines a recess into which said boss is received when said container is positioned onto said valve body, said boss and said recess configured to align the outlet port of said valve body with said one-way valve when said container is positioned onto said valve body.

13. A bottom fill, fluid dispensing system as in claim 11, wherein said valve body defines an exterior surface comprising a plurality of grooves spaced apart along the axial direction, and wherein the dispensing system further comprises a plurality of seals received into said plurality of grooves and configured for providing a fluid seal between said valve body and said valve housing.

14. A bottom fill, fluid dispensing system as in claim 13, wherein said plurality of seals are O-rings and are positioned along the exterior surface of said valve body such that at least one O-ring is positioned on opposing sides of the fluid inlet in the chamber of said valve housing when said valve body is in the first position or the second position.

15. A bottom fill, fluid dispensing system as in claim 11, wherein said biasing member is a spring.

16. A bottom fill, fluid dispensing system as in claim 11, wherein said valve body comprises a stem extending from the second end of said valve body and along the axial direction of the chamber of said valve housing, the stem being slidably received through an opening defined by said valve housing.

17. A bottom fill, fluid dispensing system as in claim 11, wherein said one-way valve comprises a duckbill valve.

18. A bottom fill, fluid dispensing system as in claim 11, further comprising a water filtering system including a filter for removing particles from the water, said water filtering system in fluid communication with the fluid inlet of said valve housing.

19. A bottom fill, fluid dispensing system as in claim 11, wherein said valve housing further comprises an exterior surface having a threaded portion, and wherein said valve housing is mountable to the countertop by positioning retainer nuts on opposing sides of the countertop and in engagement with the threaded portion of said valve housing.

20. A bottom fill, fluid dispensing system as in claim 11, wherein the first end of said valve body further comprises a top plate, wherein said outlet port extends through the top plate, and wherein the top plate is in contact with said container when said container is positioned onto said valve body.

* * * * *